US008106587B2

(12) United States Patent
Park et al.

(10) Patent No.: US 8,106,587 B2
(45) Date of Patent: Jan. 31, 2012

(54) EXTERNAL LIGHT-SHIELDING LAYER AND DISPLAY APPARATUS HAVING THE SAME FOR IMPROVING CONTRAST RATIO OF THE DISPLAY APPARATUS

(75) Inventors: Dae Chul Park, Suwon-si (KR); Seok Won Kim, Busan (KR); Young Min Koo, Gumi-si (KR)

(73) Assignee: Samsung Corning Precision Materials Co., Ltd., Gyeongsangbuk-Do (KR)

( * ) Notice: Subject to any disclaimer, the term of this patent is extended or adjusted under 35 U.S.C. 154(b) by 483 days.

(21) Appl. No.: 11/878,835

(22) Filed: Jul. 27, 2007

(65) Prior Publication Data

US 2008/0042544 A1 Feb. 21, 2008

(30) Foreign Application Priority Data

Aug. 18, 2006 (KR) ..... 10-2006-0078377
Apr. 30, 2007 (KR) ..... 10-2007-0042236

(51) Int. Cl.
*H01J 17/49* (2006.01)

(52) U.S. Cl. ..... 313/586; 313/489; 313/112

(58) Field of Classification Search ..... 313/582, 313/587, 112, 113, 489
See application file for complete search history.

(56) References Cited

U.S. PATENT DOCUMENTS 6,657,387 B1 * 12/2003 Yoo ..... 313/587
6,905,215 B2 * 6/2005 Segler, Jr. et al. ..... 353/69
7,119,479 B2 * 10/2006 Hori et al. ..... 313/110
7,271,955 B2 * 9/2007 Osawa et al. ..... 359/453
7,332,865 B2 * 2/2008 Hori et al. ..... 313/587
7,456,557 B2 * 11/2008 Park et al. ..... 313/112
7,679,275 B2 * 3/2010 Park et al. ..... 313/112
7,690,819 B2 * 4/2010 Seo ..... 362/326
7,696,678 B2 * 4/2010 Park et al. ..... 313/112
7,710,035 B2 * 5/2010 Ryu et al. ..... 313/582
7,710,036 B2 * 5/2010 Cha et al. ..... 313/582

(Continued)

FOREIGN PATENT DOCUMENTS

EP 1 441 547 A2 7/2004

(Continued)

OTHER PUBLICATIONS

European Search Report issued in European Patent Application No. EP 07113392.0/2208, dated Jan. 28, 2008.

(Continued)

*Primary Examiner* — Peter Macchiarolo
(74) *Attorney, Agent, or Firm* — McDermott Will & Emery LLP

(57) ABSTRACT

Disclosed is a display apparatus comprising a panel assembly including a plurality of light-emitting cells divided into a light-emitting region and a non light-emitting region surrounding the light-emitting region, as viewed from a viewer, and a display filter disposed on the panel assembly and including an external light-shielding layer, the external light-shielding layer having light-shielding patterns formed on a side of the external light-shielding layer, wherein an area of the light-emitting region occupies about 60% or more of a total area of the plurality of light-emitting cells, and wherein a bias angle formed by an advancing direction of the light-shielding pattern and a longitudinal side of the panel assembly is about 5 degrees or less. The external light-shielding layer is applied to the display apparatus, thereby effectively preventing the moiré phenomenon from being occurred.

15 Claims, 8 Drawing Sheets

U.S. PATENT DOCUMENTS

| | | | | |
|---|---|---|---|---|
| 7,719,188 | B2 * | 5/2010 | Ryu et al. | 313/582 |
| 2002/0036733 | A1 * | 3/2002 | Park et al. | 349/113 |
| 2003/0164243 | A1 * | 9/2003 | Arakawa et al. | 174/35 MS |
| 2004/0169826 | A1 * | 9/2004 | Segler, Jr. et al. | 353/69 |
| 2005/0212423 | A1 | 9/2005 | Kwon et al. | |
| 2006/0033448 | A1 | 2/2006 | Hur et al. | |
| 2006/0250064 | A1 * | 11/2006 | Park et al. | 313/112 |
| 2008/0012491 | A1 * | 1/2008 | Park et al. | 313/582 |
| 2008/0018247 | A1 * | 1/2008 | Park et al. | 313/582 |
| 2008/0197773 | A1 * | 8/2008 | Cha et al. | 313/582 |
| 2009/0026909 | A1 * | 1/2009 | Cha et al. | 313/112 |

FOREIGN PATENT DOCUMENTS

| | | |
|---|---|---|
| JP | 04-009093 | 1/1992 |
| JP | 05-190101 | 7/1993 |
| JP | 06-025918 | 2/1994 |
| JP | 2000-123740 | 4/2000 |
| JP | 2003-051258 | 2/2003 |
| JP | 2003-058071 | 2/2003 |
| JP | 2004-146536 | 5/2004 |
| JP | 2004-226796 | 8/2004 |
| JP | 2005-276810 | 10/2005 |
| JP | 2006-092756 | 4/2006 |
| JP | 2006-189867 | 7/2006 |
| JP | 2006-313360 | 11/2006 |
| KR | 10-2005-0113827 | 12/2005 |
| KR | 10-0579713 B1 | 5/2006 |

OTHER PUBLICATIONS

Japanese Office Action issued in Japanese Patent Application No. 2007-211941, mailed Nov. 24, 2009.

Korean Office Action issued in Korean Patent Application No. 10-2007-0042236, mailed Nov. 19, 2009.

* cited by examiner

EXTERNAL LIGHT-SHIELDING LAYER AND DISPLAY APPARATUS HAVING THE SAME FOR IMPROVING CONTRAST RATIO OF THE DISPLAY APPARATUS

CROSS-REFERENCE TO RELATED APPLICATION

This application claims the benefit of Korean Patent Application Nos. 10-2006-0078377, filed on Aug. 18, 2006, and 10-2007-0042236, filed on Apr. 30, 2007 in the Korean Intellectual Property Office, the disclosure of which is incorporated herein by reference.

BACKGROUND OF THE INVENTION

1. Field of the Invention

The present invention relates to an external light-shielding layer and a display apparatus having the external light-shielding layer, and more particularly, to an external light-shielding layer and a display apparatus having the external light-shielding layer, which can increase a contrast ratio in a bright room, and prevent a moiré phenomenon.

2. Description of Related Art

As modern society becomes more information oriented, technology of parts and devices related to image displays is remarkably advancing, and these parts and devices are becoming widespread. Display apparatuses utilizing parts and devices related to photoelectronics are becoming significantly widespread and used for television apparatuses, monitor apparatuses of personal computers, and the like. Also, display apparatuses are becoming both larger and thinner.

Plasma display panel (PDP) apparatuses are generally gaining popularity as next-generation display apparatuses to simultaneously satisfy a trend of becoming larger, and of becoming thinner, when compared with cathode-ray tubes (CRTs) representing existing display apparatuses. The PDP apparatuses display images using a gas discharge phenomenon, and exhibit superior display characteristics such as display resolution, brightness, contrast ratio, an afterimage, a viewing angle, and the like. Also, since the PDP apparatuses are generally seen as having the most appropriate characteristics for future high-quality digital televisions due to thin luminous display apparatuses of which enlargement is simpler than any other display apparatus, the PDP apparatuses are gaining popularity as display apparatuses and are replacing CRTs.

The PDP apparatus generates a gas discharge between electrodes by a direct current (DC) voltage or an alternating current (AC) voltage which are supplied to the electrodes. Here, ultraviolet light is generated. Then, a phosphor is exited by ultraviolet light, thereby emitting light.

However, the PDP apparatus has a defect in that an amount of emitted electromagnetic (EM) radiation and near infrared (NI) radiation with respect to a driving characteristic is great, surface reflectivity of the phosphor is great, and color purity due to orange light emitted from helium (He), or xenon (Xe) used as a sealing gas is lower than the CRT.

Also, EM radiation and NI radiation generated in the PDP apparatus may have harmful effects on human bodies, and cause sensitive equipment such as wireless telephones, remote controls, and the like, to malfunction. Therefore, in order to use the PDP apparatus, it is required to prevent emission of EM radiation and NI radiation emitted from the PDP apparatus from increasing to more than a predetermined level. PDP filters having functions such as an EM radiation-shielding function, an NI radiation-shielding function, a surface antiglare function, enhancement of color purity, and the like, are used for EM radiation-shielding and NI radiation-shielding while simultaneously reducing reflected light, and enhancing color purity.

The PDP apparatus is made of a panel assembly including a discharge space where a gas discharge phenomenon occurs, and a PDP filter for EM radiation-shielding and NI radiation-shielding. Since the PDP filter is equipped in a front unit of the panel assembly, transparency is required to simultaneously emit light and perform shielding functions.

External light may enter the panel assembly passing through the PDP filter in a condition that an outer surface is bright, that is, in a bright room condition with the PDP apparatus according to the conventional art. Accordingly, an overlapping between incident light generated in the discharge space of the panel assembly, and the external light entered passing through the PDP filter from the outer surface occurs. Accordingly, a contrast ratio decreases in the bright room condition, and therefore screen display capacity of the PDP apparatus is deteriorated.

BRIEF SUMMARY

An aspect of the present invention provides an external light-shielding layer for a display filter, which can increase a contrast ratio in a bright room, and prevent a moiré phenomenon.

An aspect of the present invention also provides a display apparatus having the external light-shielding layer, which can prevent a moiré phenomenon.

According to an aspect of the present invention, there is provided an external light-shielding layer for a display filter comprising a base substrate including a transparent resin, and light-shielding patterns spaced apart from one another on a surface of the base substrate at predetermined intervals, wherein a bias angle formed by an advancing direction of the light-shielding pattern and a longitudinal side of the base substrate is about 5 degrees or less.

According to another aspect of the present invention, there is provided a display filter comprising a filter base, a base substrate including a transparent resin, and light-shielding patterns spaced apart from one another on a surface of the base substrate at predetermined intervals, wherein a bias angle formed by an advancing direction of the light-shielding patterns and a longitudinal side of the base substrate is about 5 degrees or less.

According to still another aspect of the present invention, there is provided a display apparatus comprising a panel assembly including a plurality of light-emitting cells divided into a light-emitting region and a non light-emitting region surrounding the light-emitting region, as viewed from a viewer, and a display filter disposed on the panel assembly and including an external light-shielding layer, the external light-shielding layer having light-shielding patterns formed on a side of the external light-shielding layer, wherein an area of the light-emitting region occupies about 60% or more of a total area of the plurality of light-emitting cells, and wherein a bias angle formed by an advancing direction of the light-shielding pattern and a longitudinal side of the panel assembly is about 5 degrees or less.

However, those skilled in the art may understand that there is a substantial difficulty in implementing a display apparatus having an ideal ratio of light-emitting of 100%.

Preferably, the bias angle is in the range about 1.5 and about 4 degrees.

The panel assembly includes a front substrate, a rear substrate facing the front substrate, and a plurality of partition walls partitioning a plurality of discharge spaces formed between the front substrate and the rear substrate.

Also, the panel assembly includes a plurality of electrodes for causing a surface discharge on a side surface of the partition wall.

Specifically, the panel assembly comprises a transparent front substrate, a rear substrate disposed to be parallel with the front substrate, a plurality of upper partition walls disposed between the front substrate and the rear substrate and adapted to partition the discharge spaces, a first discharge electrode and a second discharge electrode disposed in the upper partition wall so as to surround the discharge spaces, a plurality of lower partition walls disposed between the upper partition wall and the rear substrate, a phosphor layer disposed in the discharge spaces; and a discharge gas injected into the discharge spaces. In this instance, the upper partition walls and the lower partition walls are formed in a lattice shape, respectively.

Also, any one of the front substrate and the rear substrate is formed in a black stripe shape, and the black stripe functions as one component of the non-light-emitting region. That is, the non-light-emitting region corresponds to either the partition wall or the black stripe shape. The transparent electrode patterns are formed on the front substrate for discharging. Here, the transparent electrode pattern is made of an opaque metal so as to prevent a signal delay of the transparent electrode pattern, and further includes bus electrode patterns passing through the light-emitting region so as to be parallel with a surface of the light-emitting region as viewed from a horizontal plane.

In addition, the bus electrode pattern is spaced apart from a first side of the light-emitting region by a predetermined distance H1, the first side being parallel with the bus electrode pattern as viewed from a viewer, and the H1 satisfies the following equation:

$$H1 \leqq 0.3 \times L1$$

(where L1 is a length of a second side of the light emitting region connected to the first side of the light-emitting region).

Further, the external light-shielding layer includes a base substrate including a transparent resin, and light-shielding patterns spaced apart from one another on a surface of the base substrate at predetermined intervals.

Also, the light-shielding pattern corresponds to any one of a wedge-shaped black stripe form, a wedge-shaped black matrix form, a wedge-shaped black wave form, a flat-shaped black stripe form, a flat-shaped black matrix form, and a flat-shaped black wave form.

In addition, the display filter is adhered to a side of the panel assembly by means of an adhesion agent.

Additional aspects, features, and/or advantages of the invention will be set forth in part in the description which follows and, in part, will be apparent from the description, or may be learned by practice of the invention.

BRIEF DESCRIPTION OF THE DRAWINGS

These and/or other aspects, features, and advantages of the invention will become apparent and more readily appreciated from the following description of exemplary embodiments, taken in conjunction with the accompanying drawings of which.

DETAILED DESCRIPTION OF EMBODIMENTS

Figure 1:
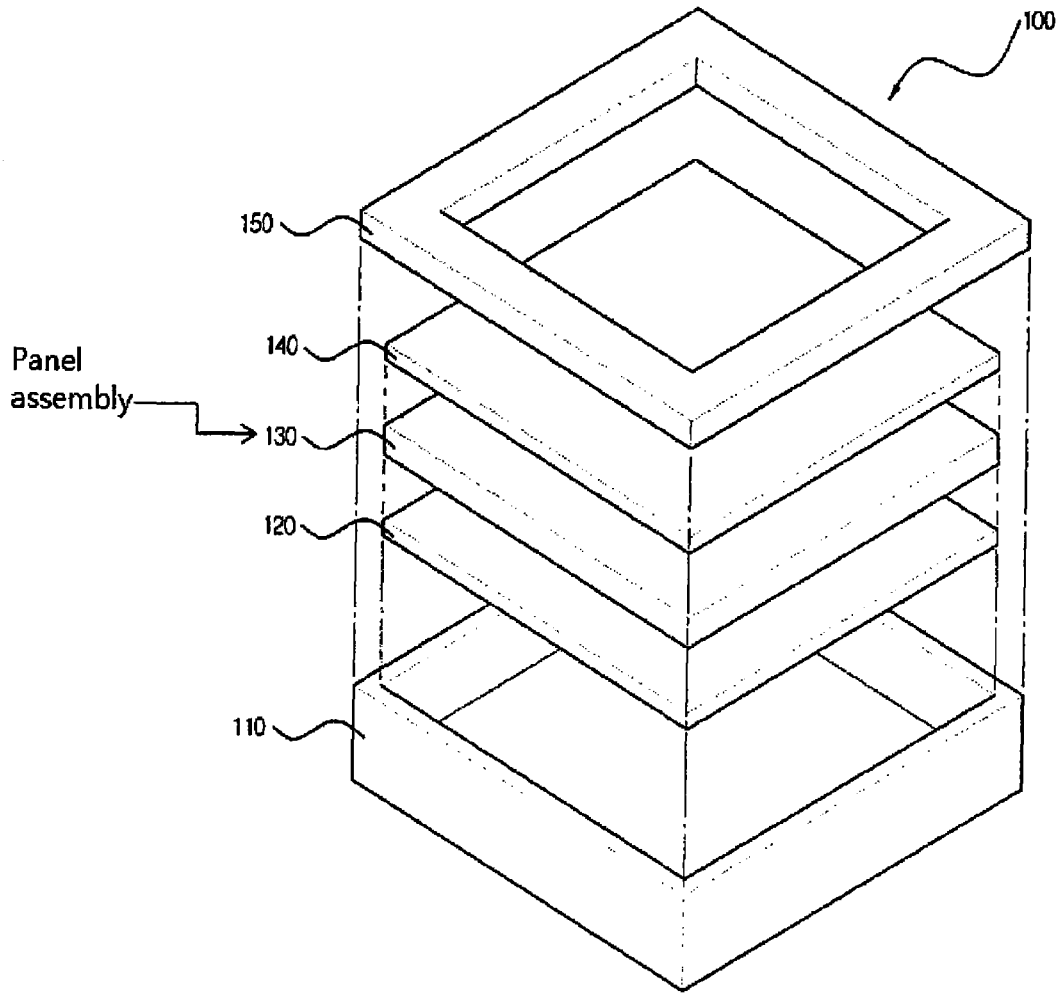
FIG. 1 is an exploded perspective view schematically illustrating a plasma display panel (PDP) apparatus according to an exemplary embodiment of the present invention.

Reference will now be made in detail to exemplary embodiments of the present invention, examples of which are illustrated in the accompanying drawings, wherein like reference numerals refer to the like elements throughout. Exemplary embodiments are described below to explain the present invention by referring to the figures.

FIG. 1 is an exploded perspective view schematically illustrating a plasma display panel (PDP) apparatus according to an exemplary embodiment of the present invention. A structure of the PDP apparatus 100 according to the exemplary embodiment of the present invention includes a case 110, a cover 150 covering an upper part of the case 110, a driving circuit board 120 received in the case 110, a panel assembly 130 including a discharge space where a gas discharge phenomenon occurs, and a PDP filter 140, as illustrated in FIG. 1. The PDP filter 140 includes a conductive layer including a material with high conductivity on a transparent substrate, and the conductive layer is grounded to the case 110 via the cover 150. Specifically, electromagnetic (EM) radiation generated from the panel assembly 130 is shielded by the cover 150 and the case 110 which are grounded using the conductive layer of the PDP filter 140, before reaching a viewer.

Hereinafter, the PDP filter 140 will be described in detail.

Figure 2:
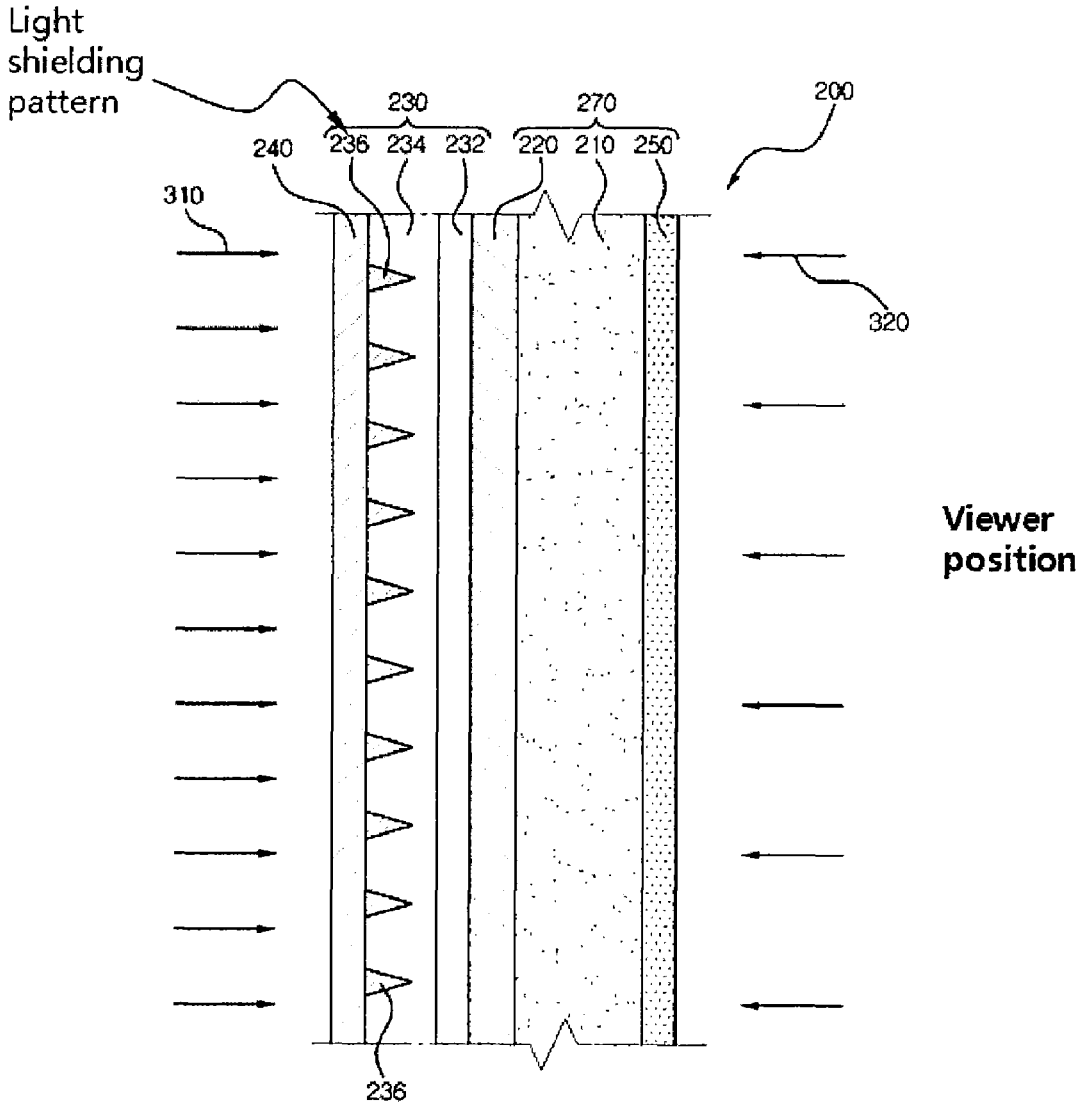
FIG. 2 is a cross-sectional view illustrating a PDP filter according to an exemplary embodiment of the present invention.
Figure 3:
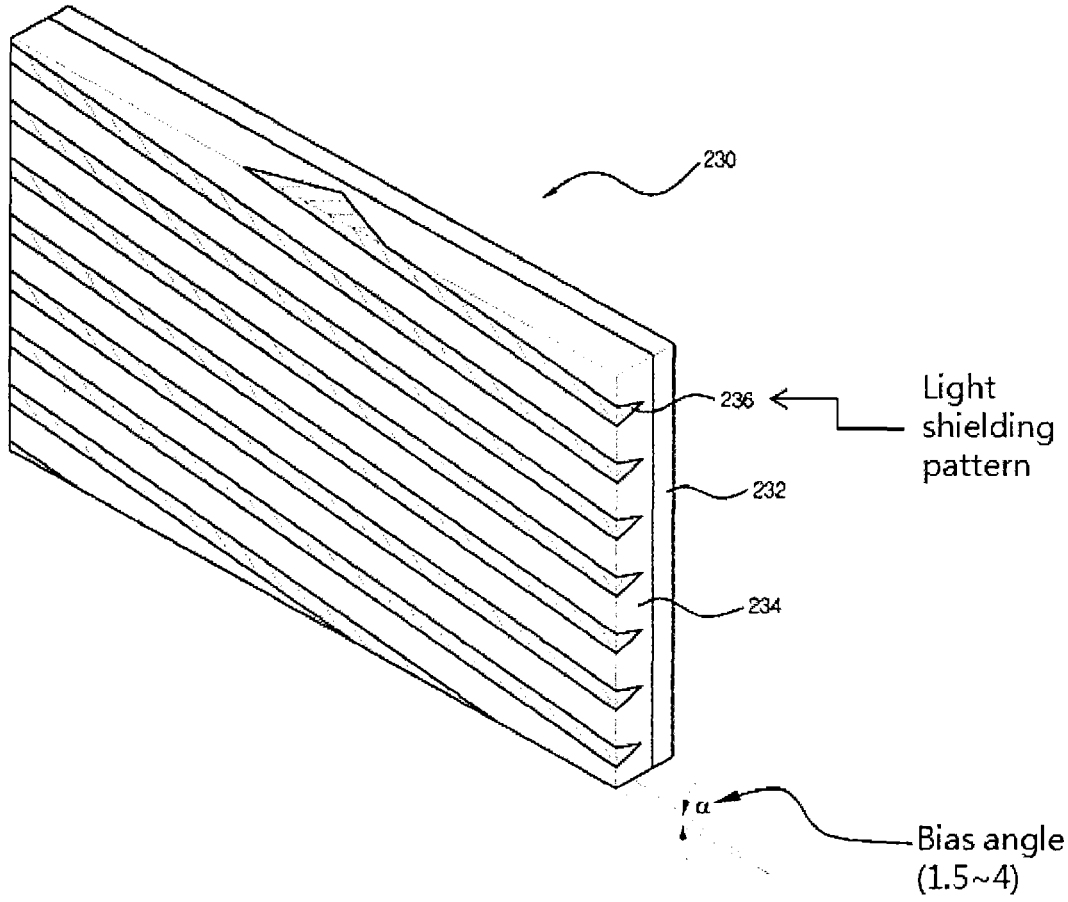
FIG. 3 is a perspective view illustrating an external light-shielding layer applied to the PDP filter illustrated in FIG. 2.

FIG. 2 is a cross-sectional view illustrating a PDP filter according to an exemplary embodiment of the present invention. FIG. 3 is a perspective view illustrating an external light-shielding layer applied to the PDP filter illustrated in FIG. 2.

As illustrated in FIG. 2, the PDP filter 200 according to the present exemplary embodiment includes a filter base 270 and an external light-shielding layer 230. The filter base 270 includes a transparent substrate 210, and layers which have various shielding functions, and the like, and are formed on the transparent substrate 210.

Here, the filter base 270 is formed by stacking the transparent substrate 210, an EM radiation-shielding layer 220, or an antireflective layer 250 regardless of order. Hereinafter, layers corresponding to an EM radiation-shielding function, and an antireflection function are described as separate layers in the present exemplary embodiment, but the present invention is not limited thereto. Specifically, the filter base 270 according to the present exemplary embodiment may include at least one layer, and each layer may have at least one function from the group consisting of the EM radiation-shielding function, and the antireflection function. Also, the filter base 270 may either collectively have the EM radiation-shielding function and the antireflection function, or have merely one function of the EM radiation-shielding function, and the antireflection function.

The external light-shielding layer 230 is disposed on a surface of the filter base 270. The external light-shielding layer 230 is disposed on a surface facing towards the panel assembly of the filter base 270, that is, an opposite surface of a viewer position when the PDP filter 200 is installed in the PDP apparatus, but the present invention is not limited thereto, and the external light-shielding layer 230 may be disposed on another surface of the filter base 270.

The external light-shielding layer 230 includes a supporter 232, a base substrate 234 formed on a surface of the supporter 232, and a light-shielding pattern 236 formed in the base substrate 234. The light-shielding pattern 236 shields the panel assembly from external light 320 entering from an outer surface of the PDP filter. The light-shielding pattern 236 in the present exemplary embodiment may include a plurality of wedge-shaped black stripes disposed in such a manner as to be spaced apart from one another in predetermined intervals. In the present exemplary embodiment, a bottom surface of the wedge-shaped black stripe is disposed in the base substrates in such a manner as to face the panel assembly.

Here, the base substrate 234 where the light-shielding pattern 236 is formed may be directly formed in the filter base 270, but the base substrate 234 may be combined with the filter base 270 after forming the base substrate 234 on the supporter 232, as illustrated in FIG. 2. The supporter 232 supports the base substrate 234 where the light-shielding pattern 236 is formed. The base substrate 234 and the surface of the filter base 270 are combined via the supporter 232 in the exemplary embodiment illustrated in FIG. 2, but the present invention is not limited thereto. Specifically, since the supporter 232 has a purpose of supporting the base substrate 234, the base substrate 234 and the filter base 270 may be directly combined when the external light-shielding layer 230 is disposed on another surface of the filter base 270.

In the exemplary embodiment of the present invention, the supporter 232 is preferably a transparent resin film transparent to the ultraviolet light. A polyethylene terephthalate (PET), a polycarbonate (PC), a polyvinyl chloride (PVC), and the like may be used for a material of the supporter 232. Also, a layer having a characteristic function of a filter such as the antireflective layer 250, the color correction layer 240, the EM radiation-shielding layer 220, and the like may be used for the supporter 232.

The light-shielding pattern 236 includes the plurality of wedge-shaped black stripes, each of which has a wedge-shape in its cross-section and disposed on the surface of the base substrate 234 facing the panel assembly (not illustrated) in such a manner as to be spaced apart from one another at predetermined intervals.

Also, the light-shielding pattern 236 prevents the external light 320 from entering an inside of the panel assembly.

The base substrate 234 is made of an ultraviolet light-curable resin, and the light-shielding pattern 236 may be made of black inorganic/organic materials capable of absorbing light, and a metal. In particular, since electric conductivity is high, that is, electric resistance is low in the case of using the metal, the electric resistance according to concentration of the metal powder may be controlled when forming the light-shielding pattern 236 by adding metal powder. Accordingly, the light-shielding pattern 236 may perform the EM radiation-shielding function. Furthermore, in the case of using a surface-blackened metal or a black metal, the light-shielding pattern 236 may efficiently perform the external light-shielding function and the EM radiation-shielding function. Also, the ultraviolet light-curable resin including carbon may be used for the light-shielding pattern 236.

The light-shielding pattern 236 of the present invention may be formed by a roll molding method, a heat press method of using a thermoplastic resin, an injection molding method in which a thermoplastic or thermo-curable resin is filled into the base substrate 234 in which an opposite shape to the light-shielding pattern 236 is totally reflected, and the like. Also, when the ultraviolet light-curable resin forming the base substrate 234 has the antireflection function, the EM radiation-shielding function, a color calibration function, or any combination thereof, the external light-shielding layer 230 may additionally perform the above functions.

The light-shielding pattern 236 constituting the external light-shielding layer 230 absorbs the external light 320, prevents the external light 320 from entering the panel assembly, and totally reflects the incident light 310 from the panel assembly to the viewer. Accordingly, a high transmittance with respect to visible light, and a high contrast ratio may be obtained.

The PDP apparatus preferably has the high transmittance with respect to visible light, and the high contrast ratio. Here, the contrast ratio may be shown as Equation 1.

$$\text{contrast ratio} = \frac{\text{brightness of (white light + reflected light)}}{\text{brightness of (black light + reflected light)}} \quad \text{[Equation 1]}$$

When the light emitted from the panel assembly is allowed to pass through the PDP filter without filtration to increase the transmittance of the PDP apparatus, both the brightness of white light and the brightness of black light are increased. Therefore, when the brightness of the PDP apparatus is increased, the entire contrast ratio is relatively decreased. A conventional PDP apparatus adopts a method of using a PDP filter including a black colorant-containing color correction film, and increasing the contrast ratio instead of reducing the transmittance of the PDP filter to a certain degree. The contrast ratio of about 120:1 can be obtained in the case of using the conventional PDP apparatus.

The PDP filter 200 of the present invention uses the light-shielding pattern 236 absorbing light instead of using the black colorant-containing color correction film. Here, the light-shielding pattern 236 partially absorbs the incident light 310 emitted from the panel assembly, and reduces the brightness of white light and black light by a predetermined portion, thereby increasing the contrast ratio. Also, according to Equation 1, the contrast ratio corresponds to a function with respect to the brightness of reflected light, and reflected light includes light reflected after the external light 320 enters the panel assembly. Here, since the external light 320 is directly absorbed in the light-shielding pattern 236, or is indirectly absorbed in the light-shielding pattern 236, although reflection occurs in the panel assembly, the brightness of reflected light may be reduced. Accordingly, although identical reflected light with respect to white light and black light is generated, the brightness of reflected light in a denominator of Equation 1 is reduced. Therefore, the contrast ratio may be increased.

When an area ratio of the bottom surface of the light-shielding pattern 236 to the surface of the base substrate 234 corresponds to about 20% to about 50%, the maximum contrast ratio may be obtained by the minimum transmittance loss. More preferably, greater effects can be obtained, when the area ratio of the bottom surface of the light-shielding pattern 236 to the surface of the base substrate 234 corresponds to about 25% to about 35%. The PDP apparatus using the PDP filter 200 including the external light-shielding layer 230 may obtain a contrast ratio greater than or equal to about 250:1, when the visible light transmittance is maintained to be greater than or equal to about 40%.

Also, the external light-shielding layer 230 has the transmittance greater than or equal to about 60% in a visible spectrum. The incident light 310 from the panel assembly is mostly incident to a vertical direction with respect to the external light-shielding layer 230. Also, a portion of the incident light 310 is absorbed in the light-shielding pattern 236. However, most portion of the incident light 310 is directly transmitted through the base substrate 234, and therefore this causes the transmittance of the PDP apparatus to be increased.

Again referring to FIG. 2, the filter base 270 has a multi-layered structure of the EM radiation-shielding layer 220 formed on the surface of the transparent substrate 210, and the antireflective layer 250 formed on the other surface of the transparent substrate 210, and the like. The present invention is not limited to the above-described stacking order, and the filter base 270 may have the multi-layered structure regardless of a stacking order of the transparent substrate 210, the EM radiation-shielding layer 220, or the antireflective layer 250.

Here, the transparent substrate 210 is generally produced using a transparent plastic material such as glass or acrylic. Also, the transparent substrate 210 may be excluded depending on a type of the filter base 270.

In the present exemplary embodiment, the transparent substrate 210 may include an inorganic compound such as glass, quartz, and the like, and transparent organic polymers.

Acrylic or polycarbonate is generally used for the transparent substrate 210 formed by the member of the organic polymer, however, the present invention is not limited to the above exemplary embodiments. The transparent substrate 210 preferably has great transparency and thermal resistance. Also, the transparent substrate 210 may include a polymeric article or stacked body of the polymeric articles. A transmittance with respect to visible light is preferably greater than about 80% concerning transparency of the transparent substrate 210, and transition temperature with respect to glass is preferably higher than about 50° C. concerning thermal resistance. It is required that the polymer used for the transparent substrate 210 is transparent in a visible wavelength range. Also, there are polyethylene terephthalate (PET), polysulfone (PS), polyether sulfone (PES), polystyrene, polyethylene naphtalate, polyarylate, polyether ether ketone (PEEK), polycarbonate (PC), polypropylene (PP), polyimide, triacetylcellulose (TAC), polymethylmethacrylate (PMMA), and the like as a specific example of the polymer used for the transparent 210, however, the polymer used for the transparent 210 is not limited thereto. The transparent substrate 210 preferably includes PET in aspects of price, thermal resistance, and transparency.

Also, it is required to cover a display surface with a highly conductive material to shield EM radiation. A multi-layered transparent conductive film stacking a conductive mesh film, a metal thin film, and a transparent thin film having a high refractive index may be used for the EM radiation-shielding layer 220 according to the present exemplary embodiment. In the present exemplary embodiment, the EM radiation-shielding layer 220 is formed on the surface of the transparent substrate 210, that is, a surface facing towards the panel assembly, but the present invention is not limited to the above disposition.

Here, a grounded metal mesh, a synthetic resin, or a mesh of a metal fiber covered with a metal may be generally used for the conductive mesh film. A metal having processibility and high electric conductivity, for example, copper, chrome, nickel, silver, molybdenum, tungsten, aluminum, and the like, may be used for the metal configuring the conductive mesh film.

Also, the transparent thin film having the high refractive index such as indium tin oxide (ITO) may be used for the multi-layered transparent conductive film in order to have the EM radiation-shielding effect. There are a multi-layered thin film alternately stacking the metal thin film such as gold, silver, copper, platinum, and palladium, and the transparent thin film having the high refractive index such as indium oxide, stannic oxide, zinc oxide, and the like as the multi-layered transparent conductive film.

The metal thin film is a thin film layer formed with silver, or an alloy including silver. Since silver and the alloy including silver has high conductivity, high reflectivity with respect to infrared light, and high transmittance with respect to visible light when stacking multi-layers, silver is preferably used. However, since silver has low chemical and physical stability, and is deteriorated by pollutants of a surrounding environment, vapor, heat, light, and the like, the alloy including silver and at least one other metal which is stable with respect to the surrounding environment such as gold, platinum, palladium, copper, indium, tin, and the like, may be also used.

Also, the transparent thin film having the high refractive index has transparency with respect to visible light, and has an effect of preventing the visible light from being reflected by the metal thin film due to a refractive index difference from the metal thin film. Specific materials forming the transparent thin film having the high refractive index are an oxide such as indium, titanium, zirconium, bismuth, tin, zinc, antimony, tantalum, cerium, neodymium, lanthanum, thorium, magnesium, potassium, and the like, combinations thereof, zinc sulfide, and the like.

Although it is also not illustrated, the filter base 270 according to the present exemplary embodiment may separately include an NI radiation-shielding layer. The NI radiation-shielding layer is generated from the panel assembly, and shields the strong NI radiation causing electronic devices such as wireless phones, remote controls, and the like, to malfunction.

There is an effect that the multi-layered transparent conductive film shields NI radiation, when the multi-layered transparent conductive film stacking the metal thin film and the transparent thin film having the high refractive index is used for the EM radiation-shielding layer 220 according to the present exemplary embodiment. Accordingly, two functions corresponding to an NI radiation-shielding function and the EM radiation-shielding function may be simply performed by the EM radiation-shielding layer 220 without separately forming the NI radiation-shielding layer. Also, the NI radiation-shielding layer described as follows may be separately formed in this case.

When the conductive mesh film is used for the EM radiation-shielding layer 220 in the present exemplary embodiment, a polymeric resin, including a colorant absorbing NI radiation which absorbs a wavelength of a NI radiation range, is used to shield NI radiation emitted from the panel assembly. For example, an organic dye of various materials such as cyanine, anthraquinone, naphthoquinone, phthalocyanine, naphthalocyanine, dimonium, nickeldithiol, and the like, may be used for the colorant absorbing NI radiation. Since the PDP apparatus emits the strong NI radiation extending over a wide wavelength range, the NI radiation-shielding layer absorbing the NI radiation extending over the wide wavelength range may be used.

When the transparent conductive film is used for the EM radiation-shielding layer 220 according to the present exemplary embodiment of the invention, the EM radiation-shielding function is relatively deteriorated, as compared to the case where the conductive mesh film is used for the EM radiation-shielding layer 220, however, when the EM radiation-shielding function is complemented or strengthened by adding the metal powder to the light-shielding pattern 236, the EM radiation-shielding function is sufficiently realized with merely the transparent conductive film.

The antireflection layer 250 according to the present exemplary embodiment is formed on the other surface of the transparent substrate 210, but the present invention is not limited to the above built-up sequence. As illustrated in FIG. 2, it is efficient that the antireflection layer 250 is formed in a surface corresponding to a viewer position when the PDP filter 200 is installed in the PDP apparatus, that is, the opposite surface of the panel assembly. The antireflection layer 250 may enhance visibility by reducing reflection of an external light.

Also, external light reflection of the PDP filter 200 may be further reduced by forming the antireflective layer 250 on a surface in the direction of the panel assembly from main surfaces of the PDP filter 200. Also, the transmittance with respect to visible light from the panel assembly and a contrast ratio may be increased by forming the antireflective layer 250 and reducing external light reflection of the PDP filter 200.

The PDP filter 200 according to the present exemplary embodiment may further include the color correction layer 240. The color correction layer 240 modifies or corrects color balance by reducing or controlling an amount of a red color (R), a green color (G), and a blue color (B).

Since the light inherently emitted from plasma and the light that the external light is emitted being reflected from the panel assembly again are the orange color, the orange color is significantly emitted from the panel assembly. The PDP filter 200 according to the present exemplary embodiment may basically reduce an amount of the orange incident light 310 by utilizing the external light-shielding layer 230, and preventing the external light 320 from entering the panel assembly. Accordingly, the PDP filter 200 of the exemplary embodiment may enhance color purity without additionally reducing an amount of the colorant used for correcting the orange color, or using the colorant. For example, when red, green, and blue colors (RGB) are established in middle image gradation (50 IRE) in a bright room (150 lux (lx)), color coordinates are sought with a measuring instrument with respect to each color, and an area ratio of measured color coordinates is sought, compared with an area concerning color coordinates of characteristic colors, it becomes apparent that high color purity may be obtained. The high color purity may be obtained due to an area ratio of about 86%, when measured via the PDP filter 200, compared with a fact that an area ratio of about 66% is obtained, when directly measured in the panel assembly.

The color correction layer 240 uses various colorants in order to increase a range of color reproduction of a display, and enhance distinction of a screen. Dyes or pigments may be used for the colorant. Types of colorants are organic colorants having a neon light shielding function such as anthraquinone, cyanine, azo, stilbene, phthalocyanine, methane, and the like, and the present invention is not limited thereto. Since kinds and concentrations of the colorants are determined by absorption wavelength, absorption coefficients, and transmittance characteristics required for displays, various numerical values may be used without being limited to a specific value.

When each layer or each film of the PDP filter 200 is stuck together, a transparent gluing agent or adhesive may be used. As a specific material, there are an acrylic adhesive, a silicon adhesive, an urethane adhesive, a polyvinyl butyral adhesive (PMB), an ethylene-vinyl acetate adhesive (EVA), a polyvinyl ether, a saturated amorphous polyester, a melamine resin, and the like.

A moiré fringe may be generated by the periodic pattern of the light-shielding pattern 236 of the external light-shielding layer 230 and the periodic pattern shown in the panel assembly (structure of the light-emitting cell, electrode pattern, and the like). The moiré fringe refers to an interference fringe created when at least two periodic patterns are overlapped. As illustrated in FIG. 3, an extended line from the light-shielding pattern and a longitudinal side of the base substrate 234 are alternatively disposed in such a manner as to have a predetermined angle (a) between the extended line and the longitudinal side so as to prevent the moiré fringe created by an interference phenomenon between the discharge spaces and the external light-shielding layer. Here, in order to effectively prevent the moiré fringe, a bias angle (a) defined as an intersection angle formed by the extended line from the light-shielding pattern 236 and the longitudinal side of the base substrate 234 may be changed in its effective values according to the panel assembly structure. In order to prevent the moiré phenomenon of the panel assembly of the present invention which will be described below, the bias angle (a) must be 5 degrees or less, and preferably be in the range between 1.5 and 4 degrees. The bias angle (a) may be understood as an intersection angle of the light-shielding pattern 236 with respective to the longitudinal side (horizontal direction with respect to a viewer) of the panel assembly.

As described above, when the light-shielding pattern 236 has a predetermined angle of 5 degrees with respect to the longitudinal side of the panel assembly, the light-shielding pattern 236 is scarcely affected by various patterns of the panel assembly and a pitch of the light-shielding pattern and the like, thereby effectively preventing the moiré phenomenon of the PDP apparatus.

Hereinafter, the panel assembly according to the present invention will be described in detail. Particularly, panel assemblies described below are characterized in that the moiré phenomenon generated by the bias angle is effectively prevented.

The panel assembly according to the present exemplary embodiment includes a plurality of light-emitting cells. The light-emitting cell is a region formed between front and rear substrates of the panel assembly. The light-emitting cell is divided into a light-emitting region and a non-light-emitting region surrounding the light-emitting region, as viewed from a viewer. The light-emitting region is different from a concept of a discharge space, that is, a cell where a discharge gas is discharged. Specifically, the discharge space is varied depending upon shapes of lattices, however, the light-emitting cell denotes a pixel corresponding to one optical unit. Unlike this, the discharge space is varied depending upon types of partition walls of the panel assembly, for example, a stripe patterned-partition wall, a lattice patterned-partition wall, and the like.

Figure 4:
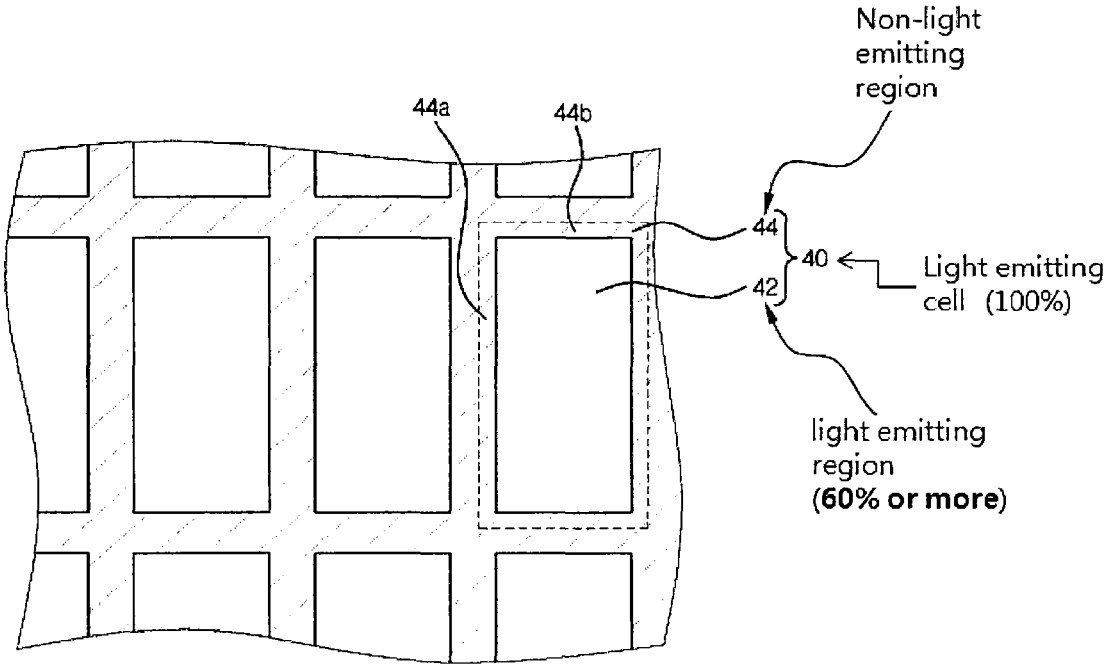
FIG. 4 is a schematic plan view illustrating a plurality of light-emitting cells of a panel assembly according to an exemplary embodiment of the present invention.

FIG. 4 is a schematic plan view illustrating a plurality of light-emitting cells of a panel assembly according to an exemplary embodiment of the present invention. In this instance, the emitting cell has a planar area as viewed from a viewer.

Referring to FIG. 4, the light-emitting cells 40 are divided into a light-emitting region 42 and a non-light-emitting region 44. The light-emitting cells 40 are successively formed in such a manner as to be adjacent one another. The light-emitting cells illustrated in FIG. 4 may not all be formed on the same plane. That is, FIG. 4 illustrates the light-emitting cells 40 as viewed from the viewer.

The light-emitting regions 42 may correspond to any one of a red light-emitting region, a green light-emitting region, and a blue light-emitting region, respectively, and serve as color pixels capable of realizing various colors by permitting the light-emitting regions expressed by three different colors to consist of a group.

The non-light-emitting region 44 may be a region corresponding to a portion of the partition walls in the case of the panel assembly having lattice shaped-partition walls. Also, in the case of the panel assembly having the stripe-patterned partition walls, the non-light-emitting region 44 may be either a region corresponding to a portion of the partition wall or a region corresponding to a portion of the black stripe formed on the front substrate. Specifically, the non-light-emitting region 44 corresponds to portions to be seen as a black color as viewed from the viewer. For example, in the case of the panel assembly having the stripe pattern-partition wall as illustrated in FIG. 4, a non-light-emitting region 44*a* formed in a lengthwise direction may be a partition wall, and a non-light-emitting region 44*a* formed in a horizontal direction may be the light-shielding pattern (black stripe) formed on the front substrate.

In the case of the panel assembly according to the present exemplary embodiment, an area of the light-emitting region 42 occupies 60% or more of the total area of the light-emitting cells. An area ratio of the light-emitting region 42 to the total area of the light-emitting cells 40 may theoretically include the case of having an effective light-emitting area of 100%. Specifically, as the relative area ratio is being increased, portions to be seen as the black color are reduced, and conversely, as the relative area ratio is being reduced, the effective light-emitting area is reduced.

The PDP apparatus including the panel assembly having 60% or more of the relative area ratio described above and the external light-shielding layer having 5 degrees or less of the bias angle (a) described above exhibits superior a contrast ratio in a bright room and prevents the moiré phenomenon from being occurred. Specifically, when the relative area ratio is 60% or less, the moiré phenomenon may occur even in the case of the external light-shielding layer having the bias angle (a) of 5 degrees or less. Also, when the bias angle (a) is 5 degrees or more even though the relative area ratio is 60% or more, the moiré phenomenon may occur.

The present exemplary embodiment focuses on the PDP apparatus, however, the external light-shielding layer of the present invention may be applied to typical display apparatuses where the light-emitting region occupies 60% or more of the entire area of the light-emitting cells. That is, those skilled in the art may readily apply the external light-shielding layer according to the present invention to the panel assembly in order to prevent the moiré phenomenon from occurring on a liquid crystal display (LCD) apparatus and the like.

Figure 5:
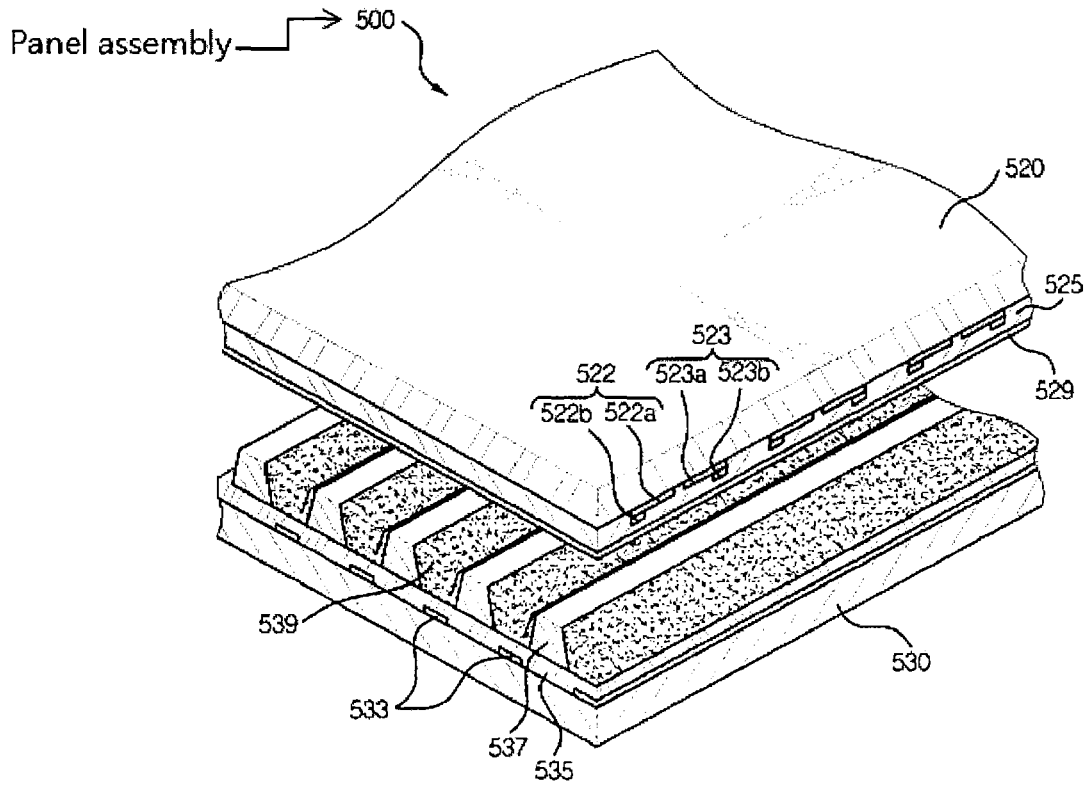
FIG. 5 is an exploded perspective view illustrating a panel assembly of a PDP apparatus according to an exemplary embodiment of the present invention.

FIG. 5 is an exploded perspective view illustrating a panel assembly of a PDP apparatus according to an exemplary embodiment of the present invention.

The panel assembly 500 of the PDP apparatus according to an exemplary embodiment of the present invention is an AC-driven three-electrode surface discharge PDP. The panel assembly 500 of the PDP apparatus comprises a front substrate 520 and a rear substrate 530.

The rear substrate 530 includes a plurality of address electrodes 533 for generating address discharge, a rear dielectric layer 535 for embedding the address electrodes 533 within the rear substrate, a plurality of partition walls 537 for partitioning a plurality of discharge spaces, and a phosphor layer 539 coated on both sides of the partition wall and on the rear substrate where each partition wall is not formed. In accordance with the present exemplary embodiment, the partition walls 537 have a stripe pattern.

The front substrate 520 is disposed facing the rear substrate 530 in such a manner as to be spaced apart from the rear substrate 530 by a predetermined distance. The front substrate 520 includes a plurality of common and scanning electrodes 522 and 523 for generating a sustain discharge, a front dielectric layer 525 for embedding the common and scanning electrodes 522 and 523 within the front substrate, and a support layer 529.

Each common electrode 522 includes a transparent common electrode 522*a* and a bus common electrode 522*b* disposed in a side of the transparent common electrode 522*a*. Also, each scanning electrode 523 includes a transparent scanning electrode 523*a* and a bus scanning electrode 523*b* disposed in a side of the transparent scanning electrode 523*a*.

In accordance with the present exemplary embodiment, the partition walls 537 extend in a lengthwise direction of the panel assembly 500 as viewed from a viewer, and the common and scanning electrodes 522 and 523 are patterned so as to extend in a direction that intersects the partition walls 537 orthogonally. Therefore, the external light-shielding layer as described above is disposed on an existing surface of the panel assembly 500, so that the bias angle (a) of the light-shielding pattern of the external light-shielding layer is 5 degrees or less with respect to an extended direction of the common and scanning electrodes, that is, the horizontal direction of the panel assembly 500.

Figure 6:
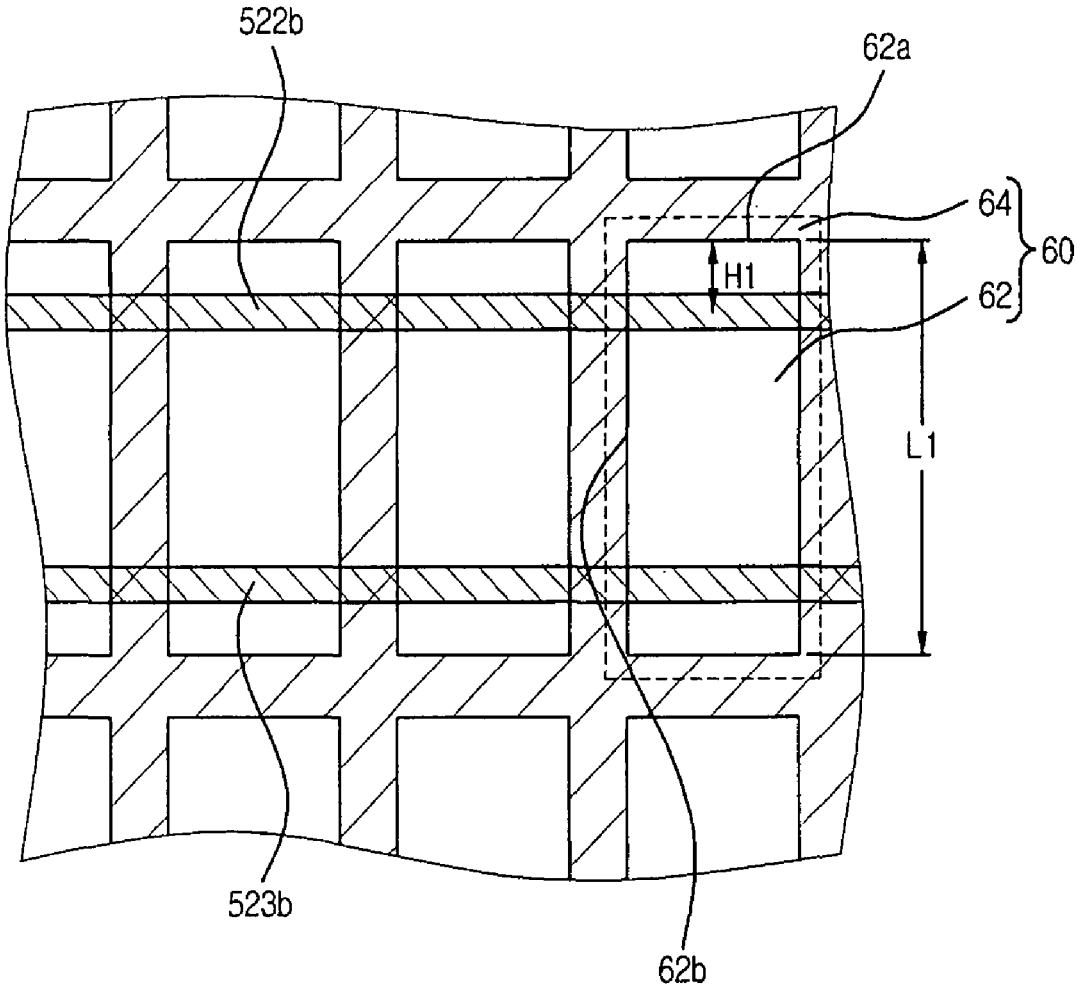
FIG. 6 is a schematic plan view illustrating the plurality of light-emitting cells of the panel assembly illustrated in FIG. 5.

FIG. 6 is a schematic plan view illustrating the plurality of light-emitting cells of the panel assembly illustrated in FIG. 5. Specifically, FIG. 6 is a plan view of the panel assembly as viewed from a viewer.

As illustrated in FIG. 6, the panel assembly includes the plurality of light-emitting cells 60, which are divided into a light-emitting region 62 and a non-light-emitting region 64. Also, as illustrated in FIG. 6, the bus common electrodes 522*b* and the bus scanning electrodes 523*b* of the front substrate 520 are seen as a black color. Since the bus electrodes 522*b* and 523*b* are made of an opaque metal which cannot transmit light, they are seen as a black color as viewed from the viewer.

As described above, an area of the light-emitting region 62 of the panel assembly 500 of the PDP apparatus according to the present exemplary embodiment occupies 60% or more with respect to the total area of the light-emitting cells 60, so that the external light-shielding having the predetermined bias angle (a) (5 degrees or less) described above is effectively applied to the panel assembly, thereby effectively preventing the moiré phenomenon from occurring. Also, even though there are differences in an effective aspect of the external light-shielding layer, the external light-shielding layer having the bias angle of 5 degrees or less is applied to other display apparatuses having 60% or less of the relative area ratio of the light-emitting region 62, thereby preventing the moiré phenomenon from occurring at a predetermined level or more.

However, the moiré phenomenon is more effectively prevented from occurring only when the external light-shielding layer is applied to the display apparatus having at least 60% or more of the relative area ratio of the light-emitting region 62 as described above.

Further, the bus electrodes 522*b* and 523*b* are disposed adjacent to a surface 62*a* of an adjacent light-emitting region being parallel with the bus electrodes 522*b* and 523*b*. Specifically, a separation distance H1 between the bus electrodes 522*b* and 523*b* and the surface of the adjacent light-emitting region (non-light-emitting region 62*a*) is adjusted so as to be 30% or less of a length L1 of a surface 62*b* of the light-emitting region orthogonally intersecting the extended direction of the bus electrodes 522*b* and 523*b*.

More particularly, in the case of the panel assembly satisfying the following Equation 2 as for positions of the bus electrodes, the external light-shielding layer according to the exemplary embodiment is applied to the panel assembly, thereby effectively preventing the moiré phenomenon from occurring.

$$H1 \leqq 0.3 \times L1 \quad \text{[Equation 2]}$$

That is, H1 is a distance between the bus electrodes and the non light-emitting region (a surface of the light-emitting region) being parallel with the bus electrodes, and L1 is a length of the surface of the light-emitting region orthogonally intersecting the non light-emitting region.

In accordance with the panel assembly of the PDP apparatus having the bus electrodes 522*b* and 523*b* satisfying the above equation 2, the external light-shielding layer including the light-shielding pattern having the predetermined angle described above is applied to the panel assembly, thereby preventing the moiré phenomenon from occurring.

Figure 7:
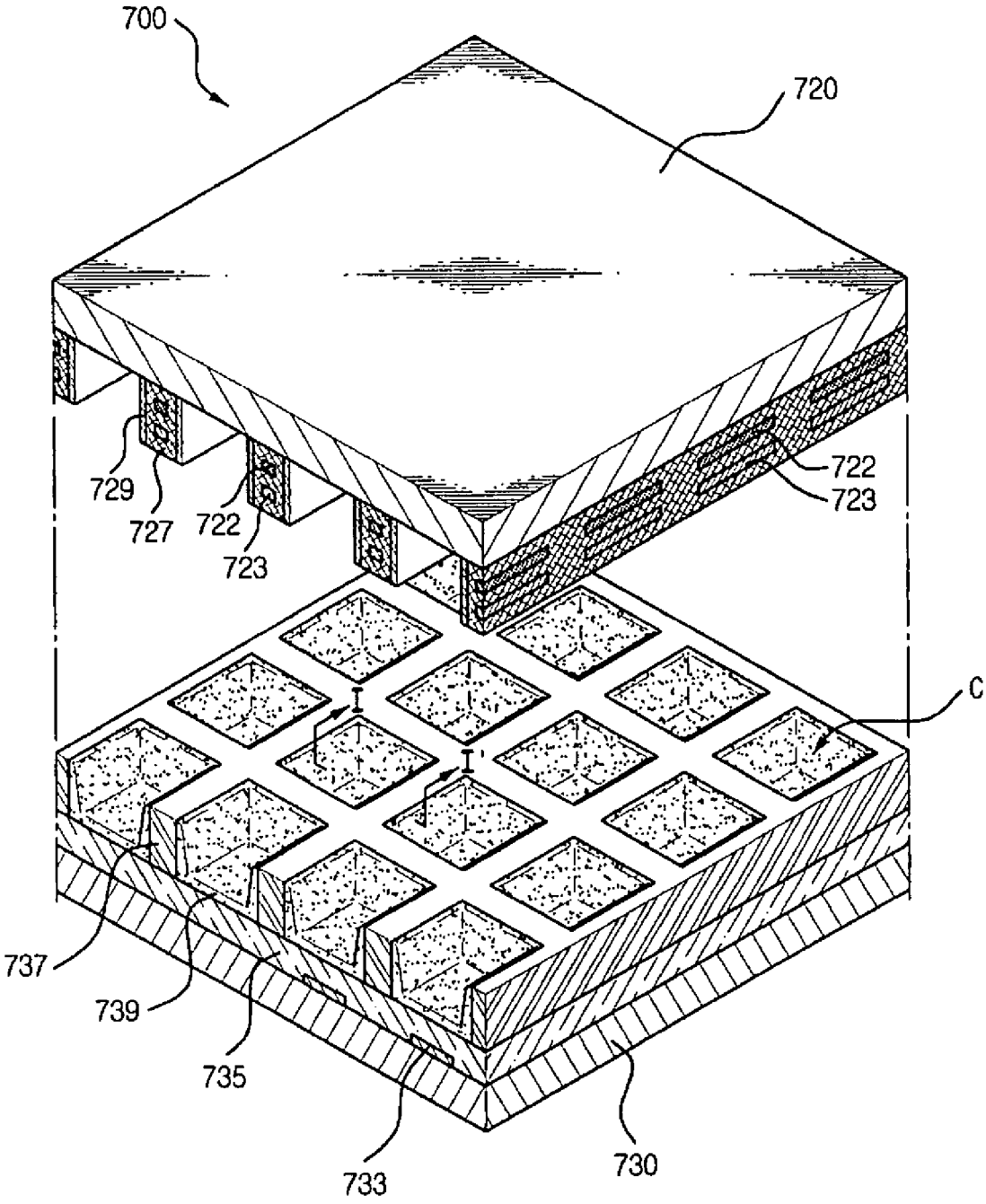
FIG. 7 is an exploded perspective view illustrating a panel assembly of a PDP apparatus according to another exemplary embodiment of the present invention.
Figure 8:
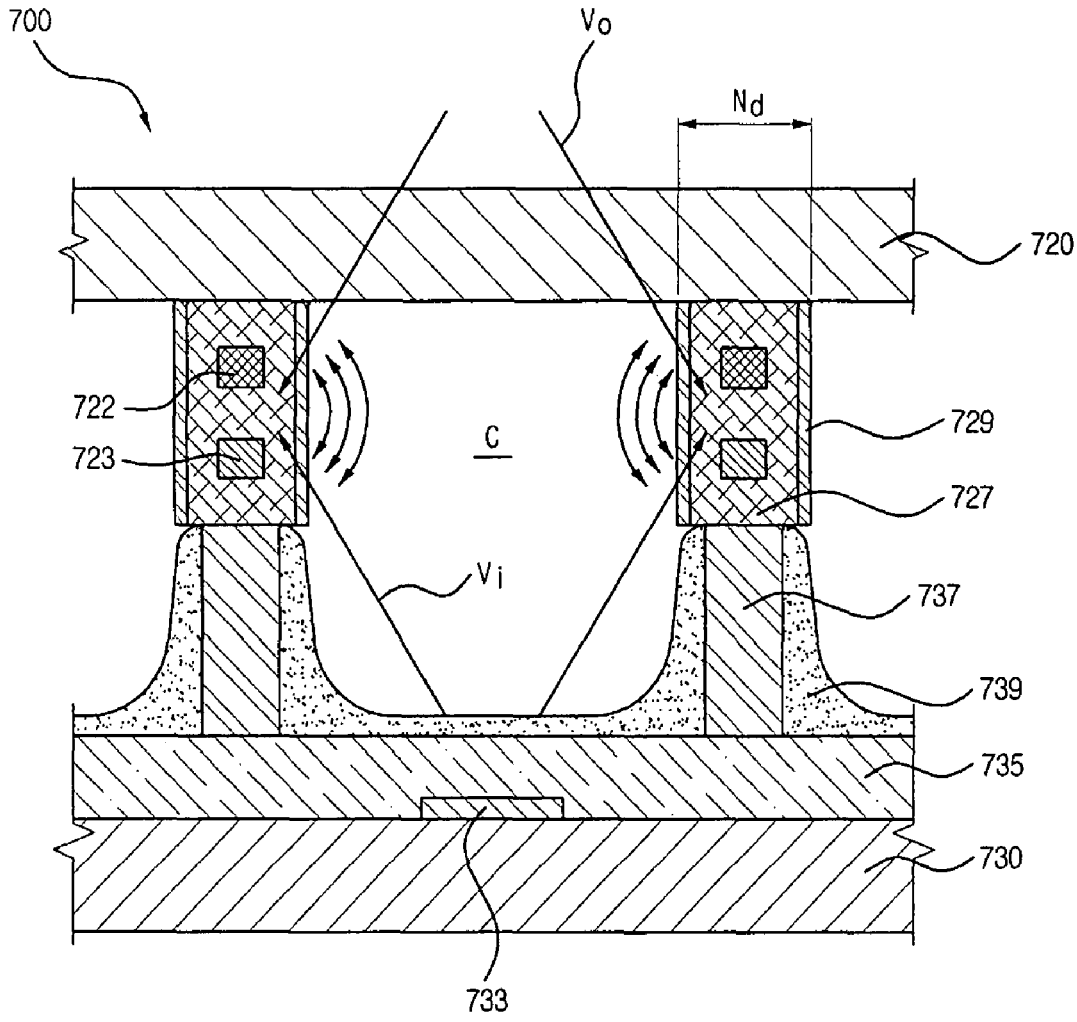
FIG. 8 is a cross-sectional view taken along line I-I' of FIG. 7.

FIG. 7 is an exploded perspective view illustrating a panel assembly of a PDP apparatus according to another exemplary embodiment of the present invention. FIG. 8 is a cross-sectional view taken along line I-I' of FIG. 7.

As illustrated in FIG. 7, another panel assembly 700 of a PDP apparatus where a surface discharge is generated on a side surface of the partition wall is provided. An external light-shielding layer including a light-shielding pattern having a predetermined bias angle (5 degrees or less) according to the present invention is applied to the panel assembly 700 of the PDP apparatus according to the present exemplary embodiment, thereby more effectively preventing the moiré phenomenon from occurring.

Referring to FIGS. 7 and 8, the panel assembly 700 of the PDP apparatus according to the present exemplary embodiment comprises a front substrate 720 and a rear substrate 730. The front substrate 720 is spaced apart from the rear substrate 730 in such a manner as to be parallel to each other. The front substrate 720 includes a plurality of upper partition walls 727 disposed on non-discharge portions and adapted to partition discharge spaces. Each upper partition wall 727 includes an upper discharge electrode 722 and a lower discharge electrode 723 formed in the upper partition wall 727 in such a manner as to surround the light-emitting region. In this case, the upper discharge electrode 722 denotes an electrode disposed above the lower discharge electrode 723. In accordance with the present exemplary embodiment, since the partition wall 727 is formed in a lattice shape, the discharge space is understood as a concept corresponding to the light-emitting region.

A plurality of lower partition walls 737 formed between the upper partition walls 727 and the rear substrate 730 functions to prevent crosstalk between charged particles. A plurality of phosphor layers 739 is disposed in cells defined by the lower partition walls 737. A discharge gas is filled in the respective discharge spaces.

Here, either the upper discharge electrode 722 or the lower discharge electrode 723 serves as an address electrode, and the remaining discharge electrode serves as a discharge electrode to generate discharge. Unlike this, as illustrated in FIGS. 2 and 3, the upper discharge electrode 722 and the lower discharge electrode 723 are extended in one direction in such a manner as to be parallel to each other, respectively. Also, a plurality of address electrodes 733, which is extended in such a manner as to be orthogonally intersecting the upper discharge electrode 722 and the lower discharge electrode 723, are further provided. In this case, preferably, the side surface of the upper partition wall 727 is covered by a MgO film 729, the address electrode 733 is disposed between the rear substrate 130 and the phosphor layer 739, and a dielectric layer 735 is disposed between the address electrode 733 and the phosphor layer 739.

A specific example for a configuration of the panel assembly of the PDP apparatus as described above will be described in detail below. The panel assembly of the PDP apparatus comprises a rear substrate 730, a plurality of address electrodes 733, a dielectric layer 735 for covering the address electrodes, a plurality of lower partition walls 737 formed on the dielectric layer for partitioning discharge spaces C, a plurality of lower discharge electrodes 723 surrounding an upper portion of the dielectric layer and extended so as to be crossed with the address electrode, a plurality of upper partition walls 727 for surrounding the upper discharge electrode and the lower discharge electrode, a plurality of phosphor layers 739 disposed on side surfaces of the lower partition walls and on the dielectric layer where each lower partition wall is not formed, a discharge gas filling the respective light-emitting cells, and a front substrate 720 disposed on the upper partition walls so as to be parallel with the rear substrate.

The rear substrate 730 supports address electrodes 733, the dielectric layer 735, and the like, and typically includes a material having glass as its main component.

The address electrode 733 generates an address discharge so as to facilitate a sustain discharge between the lower discharge electrode 723 and the upper discharge electrode 722, and more particularly, functions to lower a voltage when the sustain discharge is initiated.

When the address electrode 733 is formed on the rear substrate 730, the upper discharge electrode may correspond to a scanning electrode and the lower discharge electrode may correspond to a common electrode. However, preferably, the upper discharge electrode 722 is the common electrode, and the lower discharge electrode 723 is the scanning electrode. This is because it is desirable that, in order to facilitate an address discharge between the scanning electrode and the address electrode 733, the scanning electrode is disposed below the common electrode. Accordingly, hereinafter, the upper and the lower discharge electrodes 722 and 723 refer to as the common electrode and the scanning electrode, respectively, for convenience of explanation.

In accordance with the present exemplary embodiment, the scanning electrode 723 and the common electrode 722 are disposed in such a manner as to surround the upper portion of the discharge spaces C. The upper portion of the discharge space denotes a portion above the lower partition wall 737.

The scanning and common electrodes 723 and 722 are disposed to be crossed with each other. However, when the address electrode 733 is formed on the rear substrate, the scanning and common electrodes 723 and 722 are preferably disposed to be parallel to each other.

Also, as illustrated in FIG. 2, the scanning and common electrodes 723 and 722 are formed as one electrode, respectively, however, unlike this, may include at least two external electrodes, respectively.

The address discharge denotes a discharge occurring between the scanning electrode 723 and the address electrode 733. When the address discharge is completed, positive ions are accumulated on the scanning electrode 723, and electrons are accumulated on the common electrode 722, thereby facilitating the sustain discharge between the scanning electrode and the common electrode.

The dielectric layer 735 includes a dielectric substance, such as PbO, $B_2O_3$, $SiO_2$, etc., which can prevent the address electrodes 733 from being damaged due to the collision of positive ions or electrons with the address electrodes 733, and can induce electric charges during discharge.

The lower partition wall 737 prevents an erroneous discharge from taking place between discharge spaces C corresponding to one sub-pixel from among sub-pixels emitting red light, sub-pixels emitting green light, and sub-pixels emitting blue light constituting unit pixels. The lower partition walls 737 are illustrated to partition discharge spaces C in a matrix pattern in FIG. 2, however they are not limited thereto, and may partition discharge spaces C in a different pattern such as a comb pattern. Also, the discharge spaces C defined by the lower partition wall 737 has a rectangle in its cross-section, however, it is not limited thereto, and may have a polygon such as a triangle and a pentagon, or a circle, oval and the like in its cross-section.

The scanning electrode 723 and the common electrode 722 denote electrodes for performing a sustain discharge. The sustain discharge for realizing images of PDP is generated between the scanning electrode 723 and the common electrode 722. Here, the scanning electrode 723 and the common electrode 722 are made of a conductive metal material such as copper, aluminum and the like. The scanning electrodes 723 extend crossing with the address electrodes means that columns of the discharge spaces C passing the address electrodes are crossed with columns of the discharge spaces C passing the scanning electrodes. Also, the common electrodes 722 extending in parallel with the scanning electrodes 723 means that the common electrodes are disposed spaced apart from the scanning electrodes by a predetermined distance.

The upper partition walls 727 partition the adjacent discharge spaces C and are formed of the dielectric material so that the scanning electrodes 723 and the common electrodes 722 are prevented from directly conducting during the sustain discharge. Also, the upper partition walls 727 prevent the electrodes 722 and 723 from being damaged when the charged particles are directly collided with the electrodes, and induce the charged particles to the wall.

In accordance with the panel assembly of the PDP apparatus according to the present exemplary embodiment of the invention, both the scanning electrodes and the common electrodes are embedded in the upper partition walls. As a result, an effective light-emitting area is substantially increased as compared to the panel assembly of the PDP apparatus in FIG. 5. Also, the panel assembly of the PDP apparatus according to the present exemplary embodiment adapts the external light-shielding layer according to the present exemplary embodiment, thereby effectively preventing the moiré phenomenon.

Hereinafter, in order to verify occurrence of the moiré phenomenon according to the ratio of the light-emitting region area to the light-emitting cell area (effective light-emitting area), the results observed by using a PDP apparatus including two panel types, each having a different effective light-emitting area from each other will be described.

Test 1

An occurrence of the moiré phenomenon in two respective 42-inch PDP apparatuses each having different panel types (A-type module and B-type module) was verified as shown in Table 1 below.

TABLE 1

| | A-type module | B-type module |
|---|---|---|
| Cell structure (length * width) | 304 * 693 | 304 * 693 |
| Cell area | 210672 | 210672 |
| Effective light-emitting area of cells | 125222 | 158242 |
| Ratio | 0.59439318 | 0.751129718 |

As can be seen from Table 1, the panel of the A-type module had the ratio of the effective light-emitting area of about 59%, and the panel of the B-type module has the ration of the effective light-emitting area of about 75%.

In the above respective PDP apparatuses adapting the bias angle (5 degrees or less) of the external light-shielding layer according to the present invention, the occurrence of the moiré phenomenon was observed, and it was found that the panel of the A-type module showed the moiré phenomenon under the bias angle of 5 degrees or less, even though there is a little difference according to the bias angle. Also, the panel of the B-type module did not show the moiré phenomenon.

Further, the results of simulation performed for the 42-inch PDP apparatus were expected such that when the ratio of the effective light-emitting area is at least 60% or more, the moiré phenomenon will not be shown.

Test 2

An occurrence of the moiré phenomenon in respective 50-inch PDP apparatuses each having different panel types (A-type module and B-type module) was verified as shown in Table 2 below.

TABLE 2

| | A-type module | B-type module |
|---|---|---|
| Cell structure (length * width) | 270 * 810 | 270 * 810 |
| Cell area | 218700 | 218700 |
| Effective light-emitting area of cells | 129800 | 163900 |
| Ratio | 0.59350709 | 0.749428441 |

As could be seen from Table 2, the panel of the A-type module had the ratio of the effective light-emitting area of about 59%, and the panel of the B-type module has the ration of the effective light-emitting area of about 75% in the same manner as in the 40-inch PDP apparatus.

In the above respective PDP apparatuses adapting the bias angle (5 degrees or less) of the external light-shielding layer according to the present invention, the occurrence of the moiré phenomenon was observed, and it was found that that the panel of the A-type module showed the moiré phenomenon under the bias angle of 5 degrees or less, even though there is a little difference according to the bias angle. Also, the panel of the B-type module did not show the moiré phenomenon.

Further, the results of simulation performed for the 50-inch PDP apparatus were expected such that when the ratio of the effective light-emitting area is at least 60% or more, the moiré phenomenon will not be shown.

Hereinafter, as to the PDP apparatus having the panel assembly of FIG. 5, the results obtained by verifying the occurrence of the moiré phenomenon according to variables such as position of the bus electrodes, thickness of black stripe, and the like will explained.

Test 3

Occurrence of the moiré phenomenon was verified while varying the angle of the external light-shielding layer including the light-shielding pattern formed in the wedge-shaped black stripes, which were spaced apart from one another by a predetermined distance.

The interval between the black stripes was 73.4 μm, and the ratio of an area of the bottom surface of the wedge-shaped black stripes with respect to a total area of the external light-shielding layer is 30%. The size of the light-emitting cell in the panel assembly of the PDP apparatus applied was 912*693 μm. Also, the interval between an auxiliary electrode of the panel assembly and the non light-emitting region was 109 μm, and the thickness of the auxiliary electrode is 48 μm.

As could be seen in Test 3, the moiré phenomenon is scarcely occurred when the bias angle of the black stripes with respect to the transverse direction (horizontal direction) of the panel assembly is 5 degrees or less, and more particularly, the moiré phenomenon was not substantially occurred when the bias angle is in the range between 1.5 and 3.5 degrees.

Test 4

Occurrence of the moiré phenomenon was verified while varying the angle of the external light-shielding layer including the light-shielding pattern formed in the wedge-shaped black stripes, which were spaced apart from one another by a predetermined distance.

The interval between the black stripes was 107.5 μm, and the ratio of an area of the bottom surface of the wedge-shaped black stripes with respect to a total area of the external light-shielding layer is 30%. The size of the light-emitting cell in the panel assembly of the PDP apparatus applied was 912*693 μm. Also, the interval between an auxiliary electrode of the panel assembly and the non light-emitting region was 109 μm, and the thickness of the auxiliary electrode is 48 μm.

As could be seen in Test 4, the moiré phenomenon is scarcely occurred when the bias angle of the black stripes with respect to the transverse direction (horizontal direction) of the panel assembly is 5 degrees or less, and more particularly, the moiré phenomenon was not substantially occurred when the bias angle is in the range between 2.5 and 3.5 degrees.

Test 5

Occurrence of the moiré phenomenon was verified while varying the angle of the external light-shielding layer including the light-shielding pattern formed in the wedge-shaped black stripes, which were spaced apart from one another by a predetermined distance.

The interval between the black stripes was 73.4 μm, and the ratio of an area of the bottom surface of the wedge-shaped black stripes with respect to a total area of the external light-shielding layer is 30%. The size of the light-emitting cell in the panel assembly of the PDP apparatus applied was 810*810 μm. Also, the interval between an auxiliary electrode of the panel assembly and the non light-emitting region was 159.5 μm, and the thickness of the auxiliary electrode is 48 μm.

As could be seen in Test 4, the moiré phenomenon is scarcely occurred when the bias angle of the black stripes with respect to the transverse direction (horizontal direction) of the panel assembly is 5 degrees or less, and more particularly, the moiré phenomenon did not substantially occur when the bias angle is in the range between 2.0 and 4.0 degrees.

From the results of Tests 3 through 5, it can be found that the moiré phenomenon occurred depending upon the intervals between the black stripes and the sizes of the light-emitting cells, however, when the bias angle was about 5.0 degrees or less, the moiré phenomenon was effectively prevented from occurring regardless of the intervals between the black stripes and the sizes of the light-emitting cells.

A display apparatus, such as a PDP apparatus and the like, according to the above-described exemplary embodiments of the present invention may prevent a moiré phenomenon from occurring and improve a contrast ratio by adapting an external light-shielding layer including a light-shielding pattern inclined by a predetermined bias angle with respect to a longitudinal side of the panel assembly, thereby improving image quality of the display apparatus.

Also, a display filter including an external light-shielding layer according to the above-described exemplary embodiments of the present invention may be applied to a panel assembly having a certain ratio of an effective light-emitting area, thereby preventing the moiré phenomenon from occurring depending on characteristics of the panel.

According to the above-described exemplary embodiments of the present invention, an external light-shielding layer may be effectively adapted so as to prevent occurrence of the moiré phenomenon of the PDP panel, particularly, in which a surface discharge is carried out on a side surface of a discharge space.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A display apparatus comprising:

a panel assembly including a plurality of light-emitting cells, each of the plurality of light-emitting cells being divided into a light-emitting region and a non light-emitting region surrounding the light-emitting region, as viewed from a viewer, wherein the light-emitting region emits red, blue or green color light to, in combination, render full spectrum color light, and the non light-emitting region does not emit any color light; and a display filter disposed in front of the panel assembly and including an external light-shielding layer, the external light-shielding layer having light-shielding patterns formed on a side of the external light-shielding layer, wherein the total area of all of the light-emitting regions occupies about 60% or more of the total area of the plurality of light-emitting cells, and wherein a bias angle formed by an extension direction of the light-shielding patterns and a longitudinal side of the panel assembly is in the range between about 1.5 and about 4 degrees.

2. The display apparatus of claim 1, wherein the panel assembly includes a front substrate, a rear substrate facing the from substrate, and a plurality of partition walls partitioning a plurality of discharge spaces formed between the front substrate and the rear substrate.

3. The display apparatus of claim 2, wherein the panel assembly includes a plurality of electrodes for causing a surface discharge on a side surface of the partition wall.

4. The display apparatus of claim 3, wherein the plurality of partition walls comprises:

a plurality of upper partition walls disposed between the front substrate and the rear substrate; and a plurality of lower partition walls disposed between the upper partition wall and the rear substrate, and the plurality of upper partition walls and the plurality of lower partition walls, in combination, are configured to partition the discharge spaces, wherein the panel assembly comprises:

a first discharge electrode and a second discharge electrode disposed in the upper partition wall so as to surround the discharge spaces;

a phosphor layer disposed in the discharge spaces; and a discharge gas injected into the discharge spaces.

5. The display apparatus of claim 4, wherein the upper and lower partition walls are formed in a lattice shape, respectively.

6. The display apparatus of claim 2, wherein any one of the front substrate and the rear substrate is formed in a black stripe shape.

7. The display apparatus of claim 6, wherein the non light-emitting region corresponds to either the partition wall or the black stripe shape.

8. The display apparatus of claim 2, wherein transparent electrode patterns are formed on the front substrate for discharging.

9. The display apparatus of claim 8, wherein the transparent electrode pattern is made of metal so as to prevent a signal delay of the transparent electrode pattern, and further includes bus electrode patterns passing through the light-emitting region so as to be parallel with a first side of the light-emitting region as viewed from a viewer.

10. The display apparatus of claim 9, wherein the bus electrode pattern is spaced apart from the first side of the light-emitting region by a predetermined distance H1, the first side being parallel with the bus electrode pattern as viewed from the viewer, and the H1 satisfies the following equation:

$$H1 \leqq 0.3 \times L1$$

where L1 is a length of a second side of the light-emitting region connected to the first side of the light-emitting region.

11. The display apparatus of claim 1, wherein the external light-shielding layer includes:

a base substrate including a transparent resin; and the light-shielding patterns spaced apart from one another on a surface of the base substrate at predetermined intervals.

12. The display apparatus of claim 11, wherein the light-shielding pattern corresponds to any one of a wedge-shaped black stripe form, a wedge-shaped black matrix form, a wedge-shaped black wave form, a flat-shaped black stripe form, a flat-shaped black matrix form, and a flat-shaped black wave form.

13. The display apparatus of claim 1, wherein the display filter is adhered to a side of the panel assembly by means of an adhesion agent.

14. A display apparatus comprising:

a panel assembly including a plurality of light-emitting cells, each of the plurality of light-emitting cells being divided into a light-emitting region, and a non light-emitting region surrounding the light-emitting region as viewed from a viewer, wherein the light-emitting region emits red, blue or green color light to, in combination, render full spectrum color light, and the non light-emitting region does not emit any color light; and an external light-shielding layer disposed in front of the panel assembly as viewed from a viewer and has light-shielding patterns formed on a side of the external light-shielding layer, wherein the total area of all of the light-emitting regions occupies about 60% or more of the total area of the plurality of light-emitting cells.

15. The display apparatus of claim 14, wherein a bias angle formed by an advancing direction of the light-shielding pattern and a longitudinal side of the panel assembly is about 5 degrees or less.

* * * * *